US006148653A

United States Patent [19]

Sako et al.

[11] Patent Number: 6,148,653

[45] Date of Patent: Nov. 21, 2000

[54] ROLLING APPARATUS AND A ROLLING METHOD

[75] Inventors: Akira Sako; Toru Takeguchi; Syuji Maniwa; Masashi Yoshikawa, all of Hiroshima, Japan

[73] Assignee: Mitsubishi Heavy Industries, Ltd., Tokyo, Japan

[21] Appl. No.: 09/367,345

[22] PCT Filed: Dec. 11, 1998

[86] PCT No.: PCT/JP98/05594

§ 371 Date: Aug. 12, 1999

§ 102(e) Date: Aug. 12, 1999

[87] PCT Pub. No.: WO99/30848

PCT Pub. Date: Jun. 24, 1999

[30] Foreign Application Priority Data

| | | | |
|---|---|---|---|
| Dec. 12, 1997 | [JP] | Japan | 9-342483 |
| Dec. 25, 1997 | [JP] | Japan | 9-356492 |
| Jan. 14, 1998 | [JP] | Japan | 10-005314 |

[51] Int. Cl.[7] ..... B21B 37/72

[52] U.S. Cl. ..... 72/8.8; 72/8.6; 72/11.4; 72/11.5; 72/12.5

[58] Field of Search ..... 72/8.6, 8.8, 10.3, 72/10.4, 10.7, 11.4, 11.5, 12.3, 12.5

[56] References Cited

U.S. PATENT DOCUMENTS

| | | | |
|---|---|---|---|
| 3,151,508 | 10/1964 | Holman et al. | 72/8.8 |
| 4,415,976 | 11/1983 | Cook | 72/10.4 |
| 4,656,856 | 4/1987 | Voye, Jr. | 72/11.5 |
| 5,701,774 | 12/1997 | Imanari et al. | 72/8.6 |
| 5,722,279 | 3/1998 | Ogawa et al. | 72/8.6 |

FOREIGN PATENT DOCUMENTS

| | | |
|---|---|---|
| 53-10353 | 1/1978 | Japan . |
| 56-36307 | 4/1981 | Japan . |
| 61-144209 | 7/1986 | Japan . |
| 61-29808 | 7/1986 | Japan . |
| 62-51685 | 10/1987 | Japan . |
| 4-13407 | 1/1992 | Japan . |
| 4-4913 | 1/1992 | Japan . |
| 5-65246 | 9/1993 | Japan . |
| 7-75813 | 3/1995 | Japan . |
| 7204721 | 8/1995 | Japan . |
| 8-33910 | 2/1996 | Japan . |

*Primary Examiner*—Ed Tolan

[57] ABSTRACT

The present invention aims to provide a rolling system and a rolling method capable of avoiding the occurrence of a pinch fold by effectively preventing the zigzag movement of a rear end portion of a material to be rolled. The rotational speeds (rolling speeds) of work rolls (2) of a rolling mill stand ($F_1$) from which the rear end of a plate material (6) releases, and a succeeding rolling mill stand ($F_2$) are controlled to the same value. Moreover, the tension between the rolling mill stand ($F_1$) and the rolling mill stand ($F_2$) is controlled to zero. The difference in tension between a work side and a drive side can be made null between the rolling mill stand ($F_1$) and the rolling mill stand ($F_2$). Similarly, the difference in tension between the work side and the drive side can be made null between the plurality of rolling mill stands ($F_2$ to $F_n$) during release of the rear end of the plate material (6).

11 Claims, 15 Drawing Sheets

ROLLING APPARATUS AND A ROLLING METHOD

This application is the national phase under 36 U.S.C. §371 of PCT International Application No. PCT/JP98/05594 which has an International filing date of Dec. 11, 1998 which designated the United States of America.

TECHNICAL FIELD

The present invention relates to a rolling system comprising a plurality of rolling mill stands arranged in a row, and a rolling method in this rolling system. This invention aims at avoiding the occurrence of a pinch fold by effectively preventing zigzag movement of a rear end portion of a material to be rolled.

BACKGROUND ART

A conventional example of a rolling system comprising a plurality of rolling mill stands arranged in a row will be described with reference to FIG. 13. FIG. 13 shows a schematic side view of a conventional rolling system.

On a hot rolling line, a plurality of rolling mill stands $F_1$ to $F_n$ are provided, and each rolling mill stand F is composed of a four-high roll type rolling mill 1. The four-high roll type rolling mill 1 includes a pair of (i.e., upper and lower) work rolls 2, and a pair of (i.e., upper and lower) backup rolls 3, the work roll 2 being driven in a downwardly pressed manner (i.e., a screw down manner) by a hydraulic screw down cylinder 4 via the backup roll 3. The paired upper and lower work rolls 2 are rotationally driven in symmetric directions by a drive motor (not shown) at the same speed or different speeds.

The hydraulic screw down cylinder 4 is driven by a driving device 5 provided per rolling mill 1, to roll a material 6 to be rolled (plate material) which passes through the pair of work rolls 2. Each driving device 5 is connected to a hydraulic screw down control device 7, and is fed with a drive command individually by the hydraulic screw down control device 7. The positions of a front end and a rear end of the plate material 6 are detected by a tracking device 8 based on the rotational speed of the roll, rolling load, etc.

A method for rolling the plate material 6 by the rolling system of the foregoing constitution will be described with reference to FIG. 14. FIG. 14 shows a flow chart representing a conventional rolling method.

With a roll gap between the work rolls 2 in each of the rolling mill stands $F_1$ to $F_n$ being kept "open" (S1), the plate material 6 on the rolling line is transported to the rolling mill stands $F_1$ to $F_n$ from upstream of the hot rolling line (S2). Under monitoring by the tracking device 8, the front end of the plate material 6 immediately before being engaged between the work rolls 2 of the most upstream rolling mill stand $F_1$ is detected. In synchronism with this detection, the hydraulic screw down cylinder 4 of each of the rolling mill stands $F_1$ to $F_n$ is driven in an expanded manner by the hydraulic screw down control device 7. Thus, the roll gap is adjusted and controlled to a set roll gap (S3).

Then, the timing of release of the rear end of the plate material 6 from the most upstream rolling mill stand $F_1$ is detected under monitoring by the tracking device 8. In synchronism with this detection, the hydraulic screw down cylinder 4 of the rolling mill stand $F_1$ is driven in a contracted manner by the hydraulic screw down control device 7. Thus, the roll gap of the work rolls 2 in the rolling mill stand $F_1$ is controlled to "open". The succeeding rolling mill stands $F_2$ to $F_n$, are sequentially controlled in the same manner, and a rolling operation is repeated until a command for termination of operation is issued (S4, S5).

With the foregoing conventional rolling system, as shown in FIG. 15 indicating a state as viewed along arrows B—B in FIG. 13, when a rear end 6*b* of the plate material 6 has escaped from the most upstream rolling mill stand $F_1$ on a rolling line 10, the rolling mill stand $F_2$ located immediately behind the rolling mill stand $F_1$ is screwing down the plate material 6. In this state, screw down forces, which are different between a work side Ws and a drive side Ds, may have acted on the plate material 6 at the work rolls 2 of the rolling mill stand $F_1$ releasing the rear end 6*b*, thereby having caused a difference in tension between the right and left parts of the plate material 6. In this case, when the rear end 6*b* has left the rolling mill stand F, the rear end 6*b* of the plate material 6 that has become free may follow a zigzag path, as indicated by 6*c*, because of the difference in tension.

Upon zigzag movement of the rear end 6*b* of the plate material 6 as in 6*c*, a rear end 6*c* touches a side guide or the like of the rolling line 10, and is thus folded back. This folded-back rear end 6*c* is engaged between the work rolls 2 of the succeeding rolling mill stand F as a double layer, so that a so-called pinch fold appears. When the plate material 6 is rolled with its folded rear end being engaged between the work rolls 2 of the rolling mill stand F, the surface of the work roll 2 may be flawed, whereby the work roll 2 may be cracked or ruptured. If the work roll 2 is flawed, it is necessary to reassemble the damaged work roll assembly. Consequently, the frequency of reassembling per unit time increases, and the downtime of the system increases.

The present invention has been accomplished in light of the above circumstances. Its object is to provide a rolling system and a rolling method capable of avoiding the occurrence of a pinch fold by effectively preventing the zigzag movement of a rear end portion of a material to be rolled.

DISCLOSURE OF THE INVENTION

To attain the above object, a rolling system of the present invention comprises:

- a plurality of rolling mill stands including work rolls, and allowing sequential transport, between the work rolls, of a material to be rolled, the work rolls being driven to rotate and being driven to screw down;
- travel situation detecting means for detecting a travel situation of the material to be rolled; and
- control means for drivingly controlling the work roll based on a detection signal from the travel situation detecting means.

Thus, zigzag movement of the rear end of the material to be rolled can be prevented by adjustment of the rolling speed, adjustment of the roll gap, and adjustment of work roll leveling, so that the occurrence of a pinch fold can be avoided.

The rolling system of the present invention also comprises:

- a plurality of rolling mill stands including work rolls, and allowing sequential transport, between the work rolls, of a material to be rolled, the work rolls being driven to rotate and being driven to screw down;
- rotational speed adjusting means for adjusting the rotational driven speed of the work roll;
- roll gap adjusting means for setting a roll gap by adjusting a screw down situation of the work roll;
- position detecting means for detecting a moving position of an end portion of the material to be rolled on a hot rolling line; and a control device for sequentially performing at least one of rotational speed adjustment of the work rolls by the rotational speed adjusting means, and opening-direction adjustment of the roll gap of the work rolls by the roll gap adjusting means when a rear end of the material to be rolled, immediately before being released from the rolling mill stand, is detected by the position detecting means, so that the tension of the material to be rolled, located at least between the rolling mill stand immediately before release therefrom of the rear end of the material to be rolled and the succeeding rolling mill stand that follows it, will become zero.

Thus, the tension of the material to be rolled can be made zero by adjusting the rolling speed or adjusting the roll gap in the opening direction. Consequently, zigzag movement is not likely to occur in the rear end of the material to be rolled, so that no pinch fold develops.

The rolling system of the present invention also includes:

a tensiometer for detecting the tension of a material to be rolled which travels between a plurality of rolling mill stands; and a tension control unit for controlling a screw down cylinder of the rolling mill stand and a work roll drive motor on the basis of an actual tension detected by the tensiometer and a preset reference tension, thereby adjusting and controlling the actual tension to the reference tension.

Thus, when the material to be rolled is processed by each rolling mill stand to generate tension, the tensiometer simultaneously detects the tension of the material to be rolled. Hence, responsiveness is dramatically improved, so that the tension of the material to be rolled can be detected instantaneously and accurately. The tension control unit drivingly controls the screw down cylinder of the rolling mill stand and the drive motor that adjust and control the actual tension to the reference tension, thereby making it possible to perform in a short time a tension adjusting operation for the material to be rolled. Furthermore, the distance between the rolling mill stands can be shortened to suppress the zigzag movement of the material to be rolled. As a result, the duration of tension adjustment for the material to be rolled can be diminished to suppress fluctuations in the plate thickness and improve the accuracy of plate thickness control.

The rolling system of the present invention also includes:

a restraining roll disposed on at least one of an entry side and a delivery side of a rolling mill stand, the restraining roll comprising a pinch roll or a light pressure screw down rolling mill;

the restraining roll being provided with a pinch force detector, a thrust force detector, and a moment force detector; and a control device for adjusting work roll leveling of the adjacent rolling mill stand on the basis of information taken in from each of the detectors so that the thrust force and the moment force of the restraining roll will be reduced to zero.

Thus, extra-plane deformation due to a great restraining moment does not occur in a portion of the material to be rolled, which situates between the restraining roll and the work rolls of the adjacent rolling mill stand. Consequently, a rapid fishtailing phenomenon associated with recovery from elastic deformation during release of the rear end is avoided, so that zigzag movement of the rear end of the material to be rolled can be prevented safely and reliably.

A rolling method according to the present invention is a method for performing rolling by sequentially transporting a material to be rolled to a plurality of rolling mill stands, comprising:

detecting a travel situation of the material to be rolled; and rolling the material to be rolled, while driving work rolls of the rolling mill stand so as to rotate and screw down, in accordance with the travel situation.

Thus, zigzag movement of the rear end of the material to be rolled can be prevented by adjustment of the rolling speed, adjustment of the roll gap, and adjustment of work roll leveling, so that the occurrence of a pinch fold can be avoided.

The rolling method of the present invention is also a method for performing rolling by sequentially transporting a material to be rolled to a plurality of rolling mill stands, comprising:

performing rolling while sequentially adjusting the rotational speeds of the work rolls of the rolling mill stands when a rear end of the material to be rolled is detected to be immediately before being released from the rolling mill stand, so that the tension of the material to be rolled, located between the rolling mill stand immediately before release therefrom of the rear end of the material to be rolled and the rolling mill stand that follows it, will become zero.

Thus, zigzag movement is not likely to occur in the rear end of the material to be rolled, so that no pinch fold develops.

The rolling method of the present invention also performs rolling while increasing the rotational speeds of the work rolls of the rolling mill stand immediately before release therefrom of the rear end so that the tension of the material to be rolled will become zero. Thus, zigzag movement is not likely to occur in the rear end of the material to be rolled, so that no pinch fold develops.

The rolling method of the present invention also performs rolling while increasing the rotational speeds of the work rolls of the rolling mill stand, at least, immediately before the final stand so that the tension of the material to be rolled will become zero. Thus, simple control eliminates the risk of causing zigzag movement to the rear end of the material to be rolled, so that no pinch fold develops.

The rolling method of the present invention is also a method for performing rolling by sequentially transporting a material to be rolled to a plurality of rolling mill stands, comprising:

performing rolling while adjusting the rotational speeds of the work rolls when a rear end of the material to be rolled is detected to be immediately before being released from the most upstream rolling mill stand, so that the tension of the material to be rolled, located between all the rolling mill stands, will become zero.

Thus, simple control eliminates the risk of causing zigzag movement to the rear end of the material to be rolled, so that no pinch fold develops.

The rolling method of the present invention is also a method for performing rolling by sequentially transporting a material to be rolled to a plurality of rolling mill stands, comprising:

performing rolling while sequentially adjusting the roll gap of the work rolls in an opening direction when a rear end of the material to be rolled is detected to be immediately before being released from the rolling mill stand, so that the tension of the material to be rolled, located between the rolling mill stand immediately before release therefrom of the rear end of the material to be rolled and the rolling mill stand that follows it, will become zero.

Thus, zigzag movement is not likely to occur in the rear end of the material to be rolled, so that no pinch fold develops.

The rolling method of the present invention is also a method for performing rolling by sequentially transporting a material to be rolled to a plurality of rolling mill stands, comprising:

performing rolling while adjusting the roll gap of the work rolls in an opening direction when a rear end of the material to be rolled is detected to be immediately before being released from the rolling mill stand, so that the tension of the material to be rolled, located between all the rolling mill stands, will become zero.

Thus, zigzag movement is not likely to occur in the rear end of the material to be rolled, so that no pinch fold develops.

The rolling method of the present invention also comprises:

detecting the tension of a material to be rolled which travels between a plurality of rolling mill stands; and controlling a screw down cylinder of the rolling mill stand and a work roll drive motor so as to eliminate an error between the detected tension and a preset reference tension.

Thus, when the material to be rolled is processed by each rolling mill stand to generate tension, a tensiometer simultaneously detects the tension of the material to be rolled. Hence, responsiveness is dramatically improved, so that the tension of the material to be rolled can be detected instantaneously and accurately. Furthermore, the screw down cylinder of the rolling mill stand and the drive motor are drivingly controlled so as to eliminate the error between the actual tension and the reference tension, whereby a tension adjustment operation for the material to be rolled can be performed in a short time. Besides, the distance between the rolling mill stands can be shortened to suppress the zigzag movement of the material to be rolled. As a result, the duration of tension adjustment for the material to be rolled can be diminished to suppress fluctuations in the plate thickness and improve the accuracy of plate thickness control.

The rolling method of the present invention also comprises:

disposing a restraining roll on at least one of an entry side and a delivery side of a rolling mill stand, the restraining roll comprising a pinch roll or a light pressure screw down rolling mill;

detecting a pinch force, a thrust force, and a moment force of the restraining roll; and adjusting work roll leveling of the rolling mill stand adjacent to the restraining roll on the basis of information on the pinch force, thrust force and moment force detected so that the detected thrust force and moment force will be reduced to zero.

Thus, extra-plane deformation due to a great restraining moment does not occur in a portion of the material to be rolled, which situates between the restraining roll and the work rolls of the adjacent rolling mill stand. Consequently, a rapid fishtailing phenomenon associated with recovery from elastic deformation during release of the rear end is avoided, so that zigzag movement of the rear end of the material to be rolled can be prevented safely and reliably.

BEST MODE FOR CARRYING OUT THE INVENTION

A rolling system and a rolling method according to the present invention will now be described in detail by way of the following Embodiments with reference to the accompanying drawings.

[First Embodiment]

Figure 1:
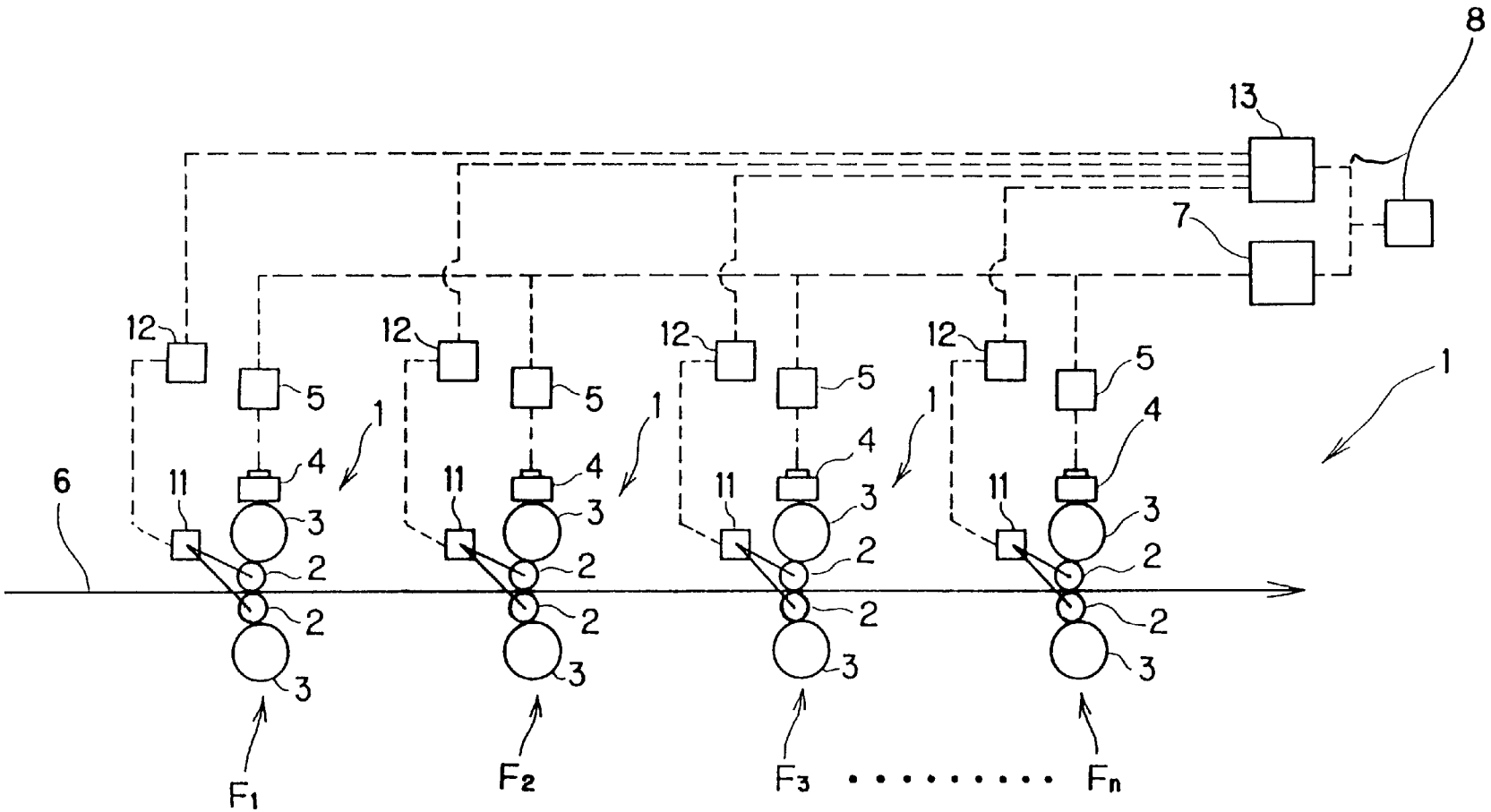
FIG. 1 is a schematic constitutional drawing of a rolling system showing a first embodiment of the present invention.
Figure 2:
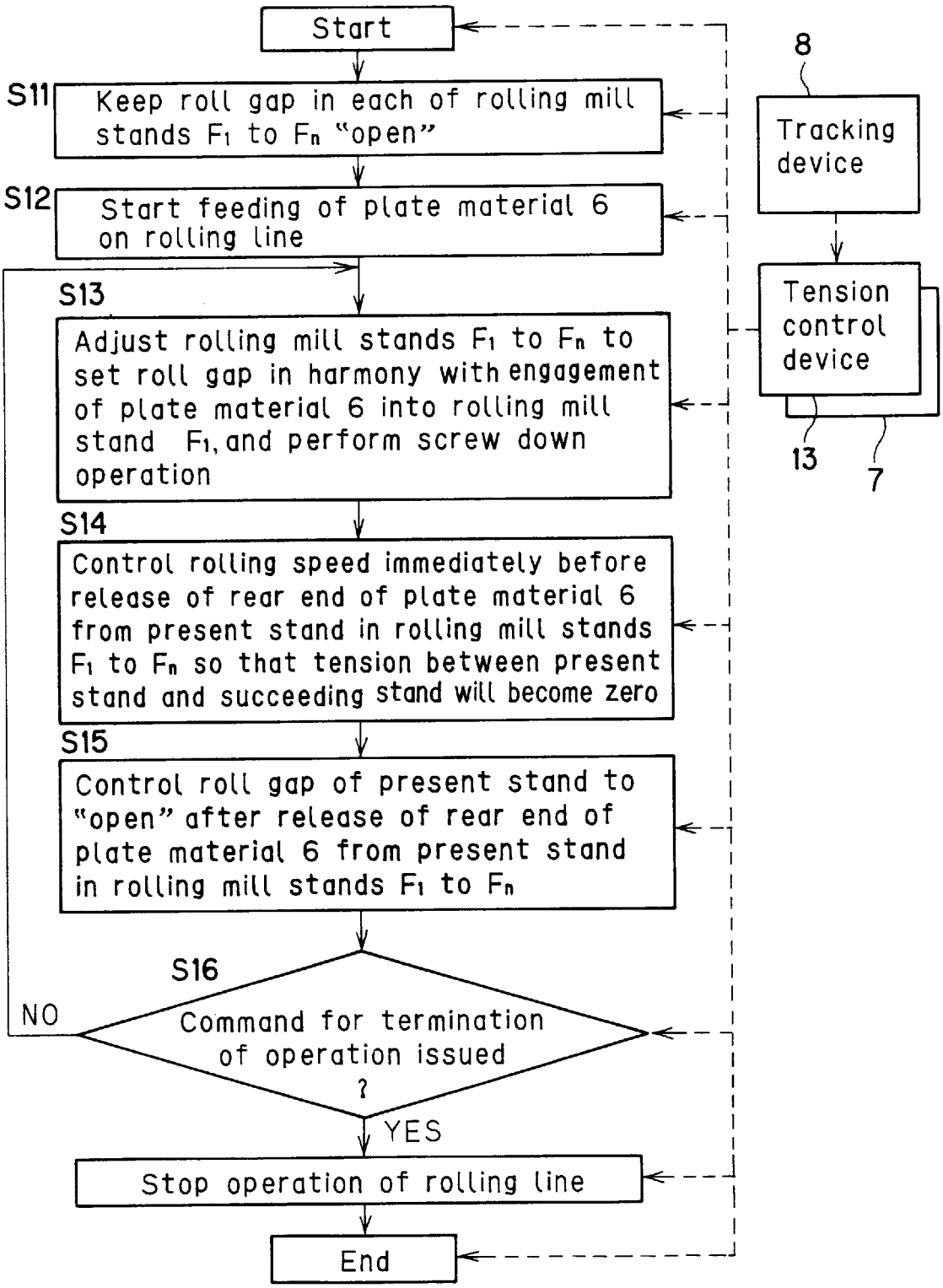
FIG. 2 is a control flow chart of a rolling method according to the first embodiment.
Figure 3:
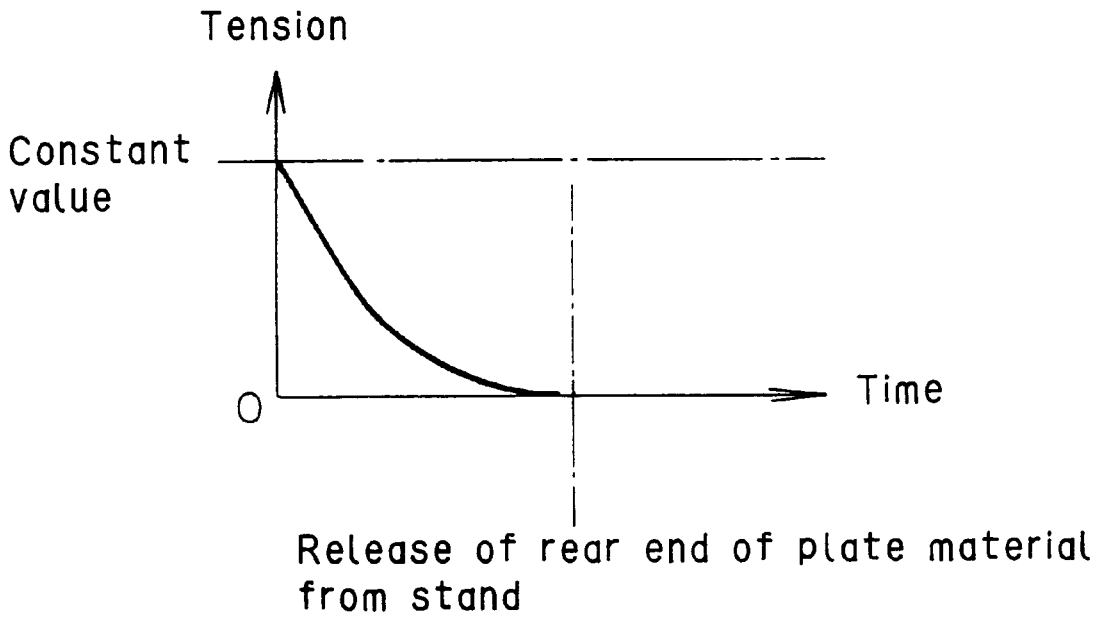
FIG. 3 is a graph showing the relationship between tension and time in the first embodiment.
Figure 13:
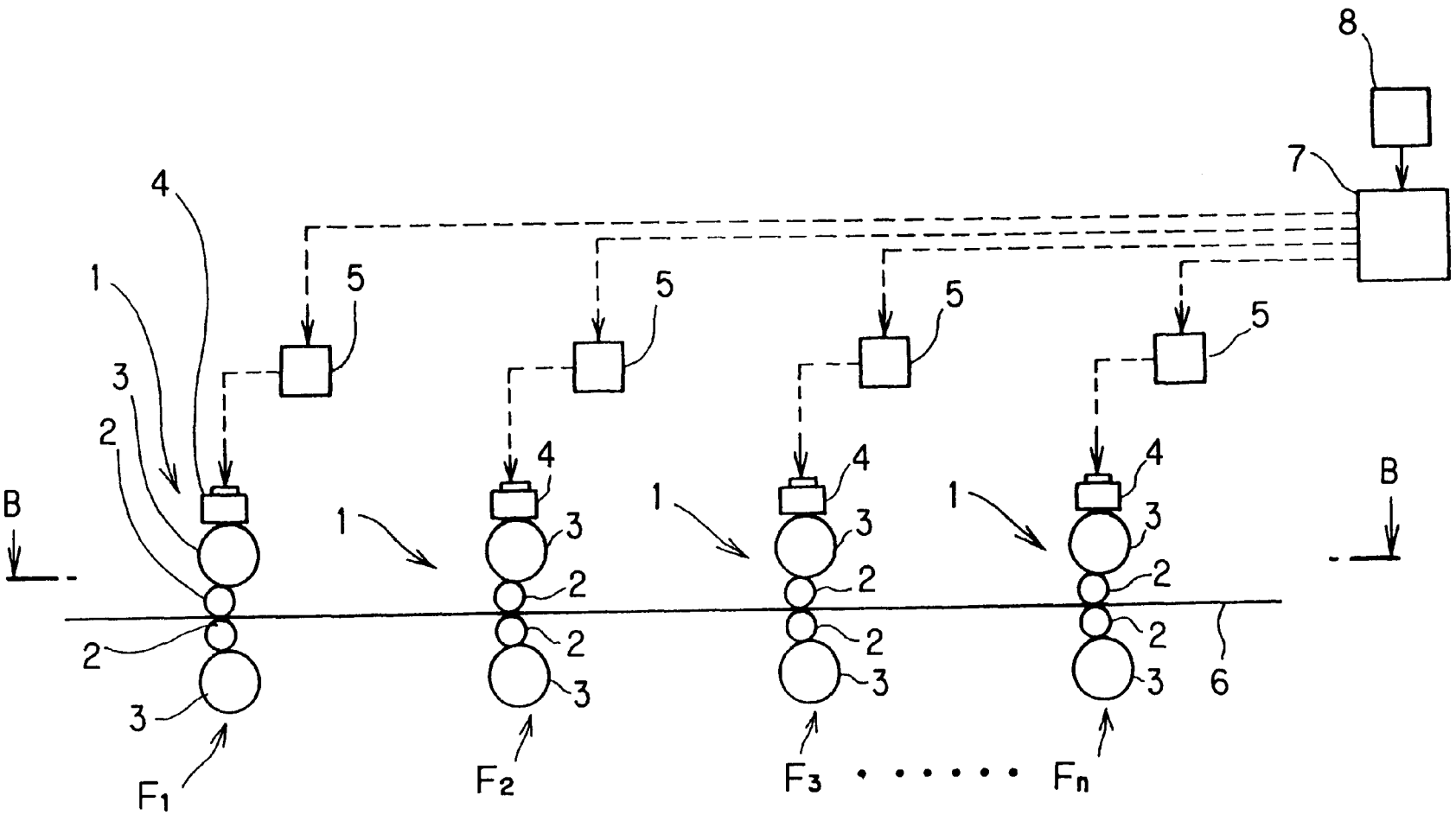
FIG. 13 is a schematic constitutional drawing of a rolling system showing a conventional example.

FIG. 1 is a schematic constitutional drawing of a rolling system according to a first embodiment of the present invention. FIG. 2 is a flow chart representing a rolling method which describes the actions of the rolling system. FIG. 3 is a graph showing the relationship between tension and time. The same members as in the rolling system illustrated in FIG. 13 are assigned the same reference numerals, and overlapping explanations are omitted.

As shown in FIG. 1, a plurality of rolling mill stands $F_1$ to $F_n$ are each composed of a four-high roll type rolling mill 1. The four-high roll type rolling mill 1 includes a pair of (i.e., upper and lower) work rolls 2, a pair of (i.e., upper and lower) backup rolls 3, and a hydraulic screw down cylinder 4. The paired upper and lower work rolls 2 are rotationally driven in symmetric directions by a drive motor 11 at the same speed or different speeds.

The hydraulic screw down cylinder 4 is driven by a driving device 5 provided per rolling mill 1, to roll a material 6 to be rolled (plate material) which passes through the pair of work rolls 2. Each driving device 5 is connected to a hydraulic screw down control device 7, and is fed with a drive command individually by the hydraulic screw down control device 7. The positions of a front end and a rear end of the plate material 6 are detected by a tracking device 8 based on the rotational speed of the roll, rolling load, etc.

The drive motor 11 is driven based on a command from a motor control unit 12 provided per rolling mill 1. The motor control unit 12 is connected to a tension control device 13 to receive a drive command individually. The tracking device 8 is connected to the hydraulic screw down control device 7 and the tension control device 13. In accordance with the situation of the front end position and rear end position of the plate material 6, the hydraulic screw down cylinder 4 and the drive motor 11 are drivingly controlled via the hydraulic screw down control device 7 and the tension control device 13.

A first embodiment of a rolling method by the foregoing rolling system will be described with reference to FIG. 2.

After a rolling line is set in motion, with a roll gap between the work rolls 2 in each of the rolling mill stands $F_1$ to $F_n$ being kept "open" (S11), the plate material 6 on the rolling line is transported to the rolling mill stands $F_1$ to $F_n$ from upstream of the hot rolling line (S12). Under monitoring by the tracking device 8, before the front end of the plate material 6 is engaged between the work rolls 2 of the most upstream rolling mill stand $F_1$, the hydraulic screw down cylinder 4 of each of the rolling mill stands $F_1$ to $F_n$ is driven in an expanded manner by the hydraulic screw down control device 7. Thus, the roll gap is adjusted and controlled to a set roll gap (S13), and a screw down operation is performed sequentially. The plurality of rolling mill stands $F_1$ to $F_n$ impart necessary tension to the plate material 6, since the rolling speeds of the succeeding rolling mill stands F are sequentially increased.

Then, under monitoring by the tracking device 8, the rear end of the plate material 6, immediately before escaping from the most upstream rolling mill stand $F_1$, is detected. Simultaneously with, and parallel to this detection, the rotational speed, i.e. rolling speed, of the drive motor 11 that drives the work rolls 2 of the most upstream rolling mill stand $F_1$ is controlled by the motor control unit 12 and the tension control device 13. By this measure, the tension of the plate material 6 between the present rolling mill stand (the most upstream rolling mill stand $F_1$) and the succeeding rolling mill stand (the rolling mill stand $F_2$) is put into a zero state (S14).

Speed adjustment of the rotational speed (rolling speed) of the drive motor 11 for achieving the zero-tension state between the respective adjacent two of the plurality of rolling mill stands $F_1$ to $F_n$ can be made by decreasing or increasing the speed of the drive motor 11 for one of the preceding and succeeding rolling mill stands F's in harmony with the speed of the drive motor 11 for the other rolling mill stand F. (Actually, it is preferred to perform rolling while increasing the rotational speed of the work rolls 2 of the rolling mill stand F on the preceding stage side (upstream side). FIG. 3 shows an example of the speed adjustment. Control for decreasing the tension of one of the rolling mill stands F's is performed such that adjustment of the rotational speed (rolling speed) of the work rolls is initiated a certain period of time before release of the rear end of the plate material 6 from the work rolls to decrease the tension slowly, and that the tension between the adjacent rolling mill stands F's is reduced to zero at a time when the rear end of the plate material 6 is released. This makes it possible to prevent the rear end of the plate material 6, for example, from jumping up because of an abrupt change in tension.

Then, the timing of release of the rear end of the plate material 6 from the most upstream rolling mill stand $F_1$ is detected under monitoring by the tracking device 8. In synchronism with this detection, the hydraulic screw down cylinder 4 of the rolling mill stand $F_1$ is driven in a contracted manner by the hydraulic screw down control device 7. Thus, the roll gap of the work rolls 2 in the rolling mill stand $F_1$ is controlled to "open". The succeeding rolling mill stands $F_2$ to $F_n$ are sequentially controlled in the same manner, and a rolling operation is repeated until a command for termination of operation is issued (S15, S16).

According to the foregoing rolling method, the rotational speeds (rolling speeds) of the work rolls 2 of the rolling mill stand F from which the rear end of the plate material 6 releases (i.e., the rolling mill stand $F_1$), and the succeeding rolling mill stand F (i.e., the rolling mill stand $F_1$) are controlled to the same value. Moreover, the tension between the rolling mill stand $F_1$ and the rolling mill stand $F_2$ is controlled to zero. Thus, the difference in tension between a work side Ws and a drive side Ds can be made null between the rolling mill stand $F_1$ and the rolling mill stand $F_2$. Similarly, the difference in tension between the work side Ws and the drive side Ds can be made null between the adjacent two of the rolling mill stands $F_2$ to $F_n$ during release of the rear end of the plate material 6. Hence, there is no risk for causing a zigzag motion to the rear end of the plate material 6, and no pinch fold occurs.

The above embodiment is an example in which tension control is performed between the rolling mill stand F from which the rear end of the plate material 6 releases, and the succeeding rolling mill stand F in the plurality of rolling mill stands $F_1$ to $F_n$. What matters most is the zigzag movement in the rolling mill stand $F_n$ in the last stage (on the most downstream side) Thus, the above-described actions and effects may be exhibited by performing rolling while increasing the rotational speed of the work rolls 2 only in the rolling mill stand $F_{n-1}$ immediately prior to the last stage.

[Second Embodiment]

Figure 4:
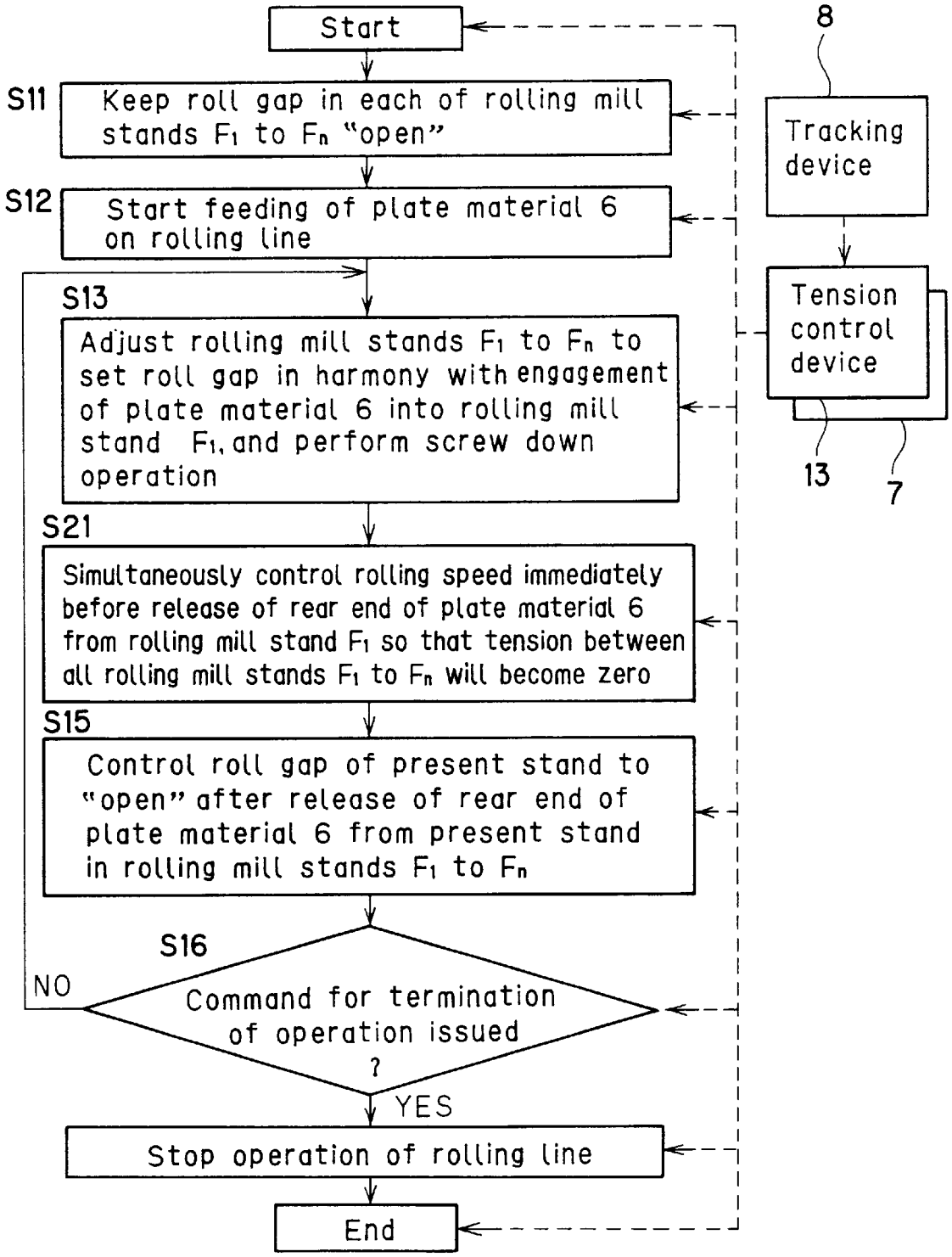
FIG. 4 is a control flow chart of a rolling method showing a second embodiment of the present invention.

Next, a second embodiment of a rolling method using the rolling system shown in FIG. 1 will be described. FIG. 4 shows a flow chart representing the actions of the rolling method as the second embodiment.

As in the embodiment shown in FIG. 2, after the rolling line is set in motion, with the roll gap between the work rolls 2 in each of the rolling mill stands $F_1$ to $F_n$ being kept "open" (S11), the plate material 6 on the rolling line is transported to the rolling mill stands $F_1$ to $F_n$ from upstream of the hot rolling line (S12). Before the front end of the plate material 6 is engaged between the work rolls 2 of the most upstream rolling mill stand F1, the work rolls 2 of each of the rolling mill stands $F_1$ to $F_n$ are adjusted and controlled to a set roll gap (S13), and a screw down operation is performed sequentially.

Then, under monitoring by the tracking device 8, the rear end of the plate material 6, immediately before escaping from the most upstream rolling mill stand $F_1$, is detected. In synchronism with this detection, the rotational speed, i.e. rolling speed, of the drive motor 11 that drives the work rolls 2 of all the rolling mill stand $F_1$ to $F_n$ is controlled by the motor control unit 12 and the tension control device 13. By this measure, the tensions of the plate material 6 between the respective adjacent two of the rolling mill stand $F_1$ to $F_n$, are simultaneously reduced to zero (S21).

Then, the timing of release of the rear end of the plate material 6 from the most upstream rolling mill stand $F_1$ is detected as in the embodiment shown in FIG. 2. In synchronism with this detection, the roll gap of the work rolls 2 in the rolling mill stand $F_1$ is controlled to "open". The succeeding rolling mill stands $F_2$ to $F_n$ are sequentially controlled in the same manner, and a rolling operation is repeated until a command for termination of operation is issued (S15, S16).

According to the foregoing rolling method, immediately before the rear end of the plate material 6 releases from the rolling mill stand $F_1$, the rotational speeds (rolling speeds) of the work rolls 2 of all the rolling mill stands $F_1$ to $F_n$ are controlled to the same value at the same time. Moreover, the tension between the respective adjacent two of the rolling mill stands $F_1$ to $F_n$ is controlled to zero. Thus, the difference in tension between the work side Ws and the drive side Ds can be made null. Hence, simple control eliminates the risk for causing a zigzag motion to the rear end of the plate material 6, and prevents the occurrence of a pinch fold.

The above First and Second Embodiments show examples in which the tracking device 8 is used as means of detecting the position of the plate material 6. However, it is preferred, for example, to install a camera on an upstream side (entry side) of the rolling mill stand $F_{n-1}$ immediately before the final stage, and perform rolling while entering image signals from the camera into the tension control device 13 and increasing the rotational speed of the work rolls 2 of the rolling mill stand $F_{n-1}$.

[Third Embodiment]

Figure 5:
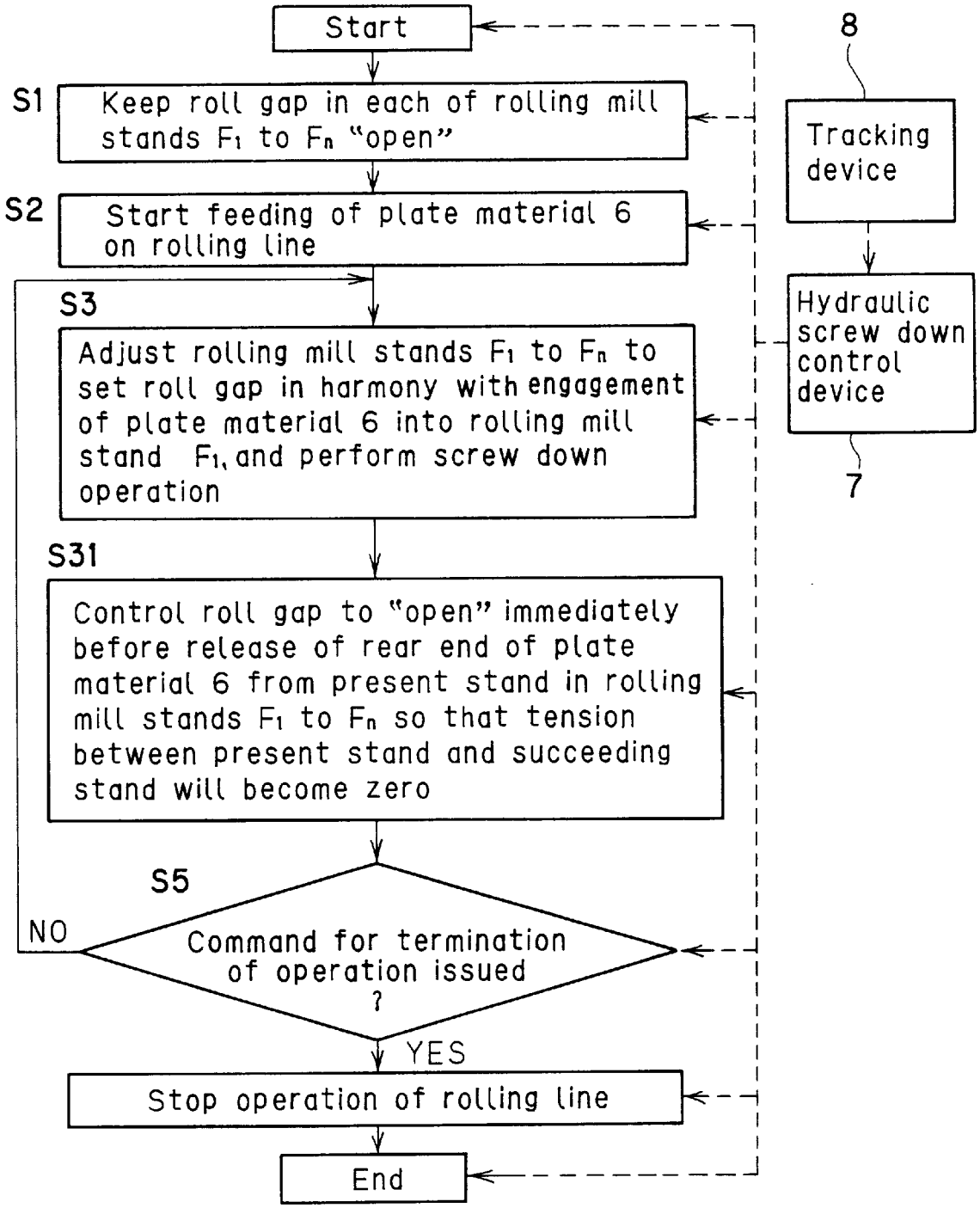
FIG. 5 is a control flow chart of a rolling method showing a third embodiment of the present invention.

Next, a third embodiment of a rolling method will be described with reference to FIG. 5. FIG. 5 shows a flow chart representing the actions of the rolling method as the third embodiment. A rolling system for performing the rolling method related to this embodiment is the rolling system illustrated in FIG. 13.

Figure 14:
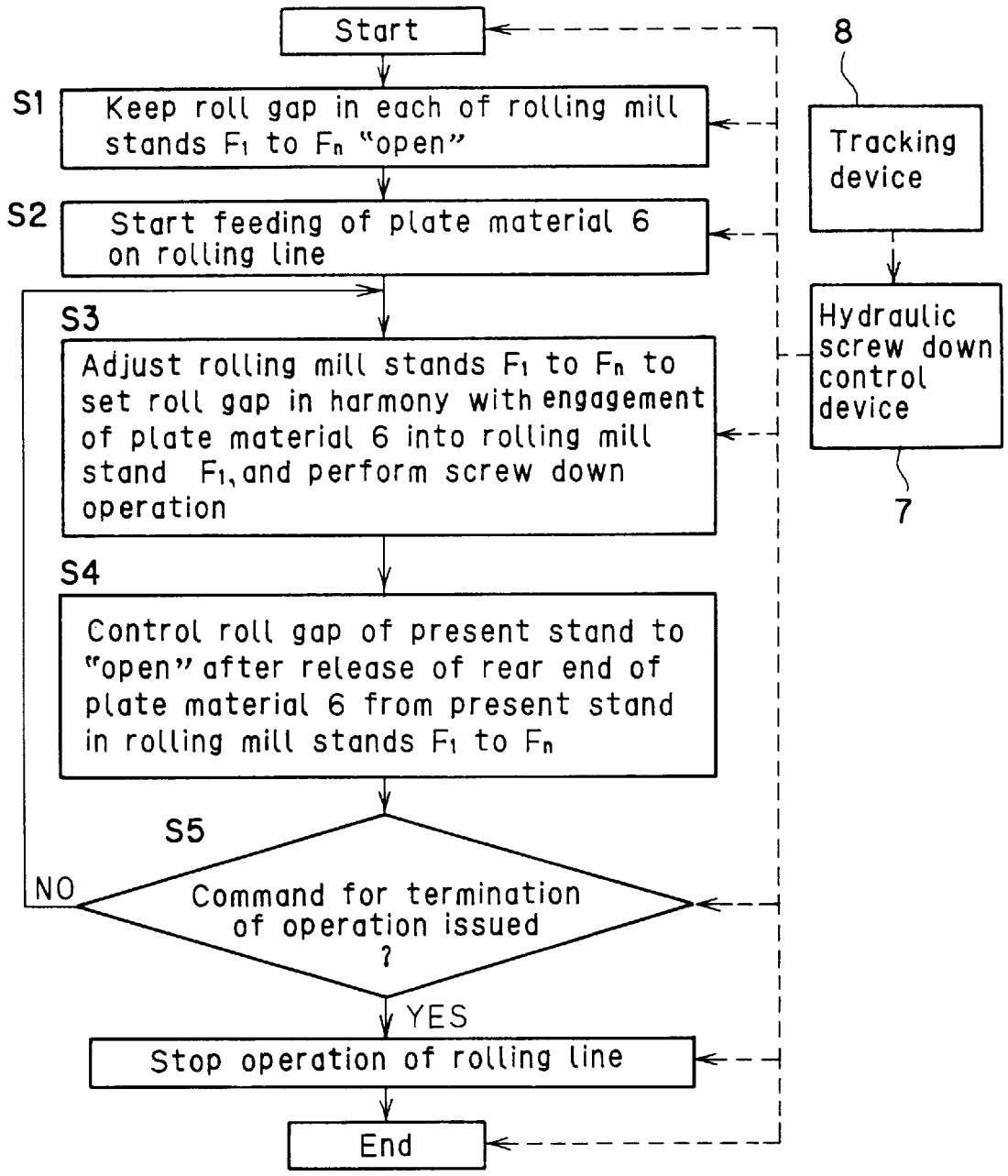
FIG. 14 is a control flow chart of a rolling method for the conventional system.
Figure 15:
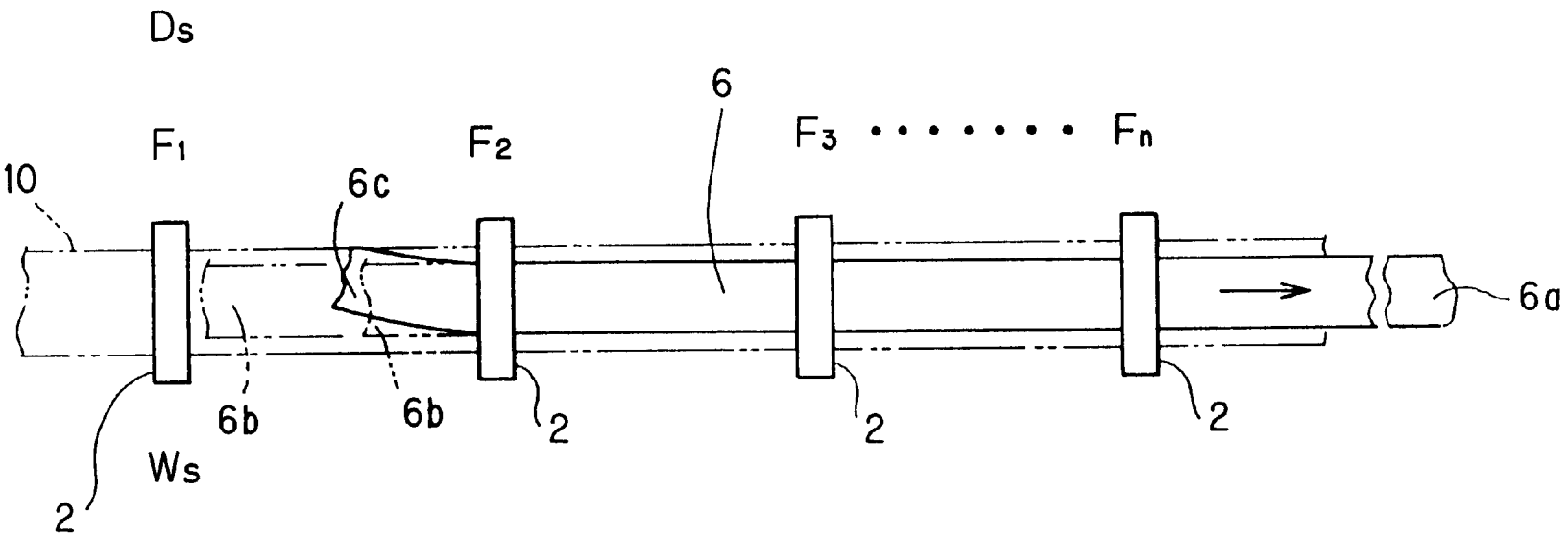
FIG. 15 is a view taken on line B—B of FIG. 13.

As in the case of the actions shown in FIG. 14, with the roll gap between the work rolls 2 in each of the rolling mill stands $F_1$ to $F_n$ being kept "open" (S1), the plate material 6 on the rolling line is transported to the rolling mill stands $F_1$ to $F_n$ , from upstream of the hot rolling line (S2). Under monitoring by the tracking device 8, the front end of the plate material 6, immediately before being engaged between the work rolls 2 of the most upstream rolling mill stand $F_1$, is detected. In synchronism with this detection, the hydraulic screw down cylinder 4 of each of the rolling mill stands $F_1$ to $F_n$ is driven in an expanded manner by the hydraulic screw down control device 7. Thus, the roll gap is adjusted and controlled to a set roll gap (S3).

Then, under monitoring by the tracking device 8, the rear end of the plate material 6, immediately before sequentially escaping from the preceding rolling mill stand $F_1$ to $F_{n-1}$is detected. Under the action of the hydraulic screw down control device 7, the roll gap of the work rolls 2 in the preceding rolling mill stand F and the succeeding rolling mill stand F is controlled to "open". Also, control is performed such that the tension between the preceding rolling mill stand F and the succeeding rolling mill stand F is reduced to zero (S31). A rolling operation is repeated until a command for termination of operation is issued (S5).

According to the foregoing rolling method, immediately before release of the rear end of the plate material 6, the roll gap of the work rolls 2 in the preceding rolling mill stand F and the succeeding rolling mill stand F is controlled to "open". Also, control is performed such that the tension between the adjacent rolling mill stands F's is reduced to zero. Thus, the difference in tension between the work side Ws and the drive side Ds can be made null between the adjacent rolling mill stands F's. Hence, there is no risk for causing a zigzag motion to the rear end of the plate material 6, and no pinch fold occurs.

[Fourth Embodiment]

Figure 6:
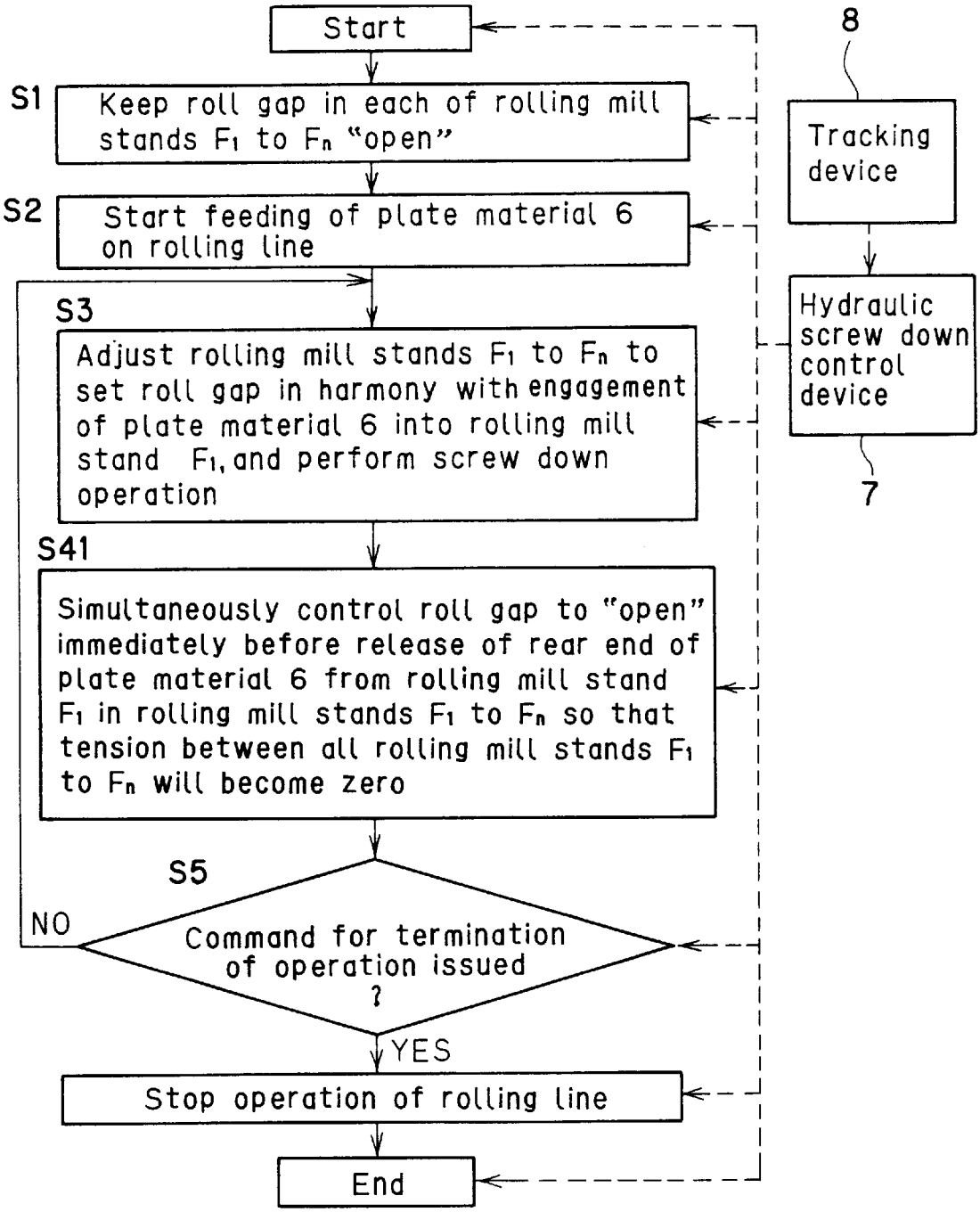
FIG. 6 is a control flow chart of a rolling method showing a fourth embodiment of the present invention.

Next, a fourth embodiment of a rolling method will be described with reference to FIG. 6. FIG. 6 shows a flow chart representing the actions of the rolling method as the fourth embodiment. A rolling system for performing the rolling method related to this embodiment is the rolling system illustrated in FIG. 13.

As in the case of the actions shown in FIG. 14, the roll gaps between the work rolls 2 in the rolling mill stands $F_1$ to $F_n$ are kept "open" (Sl), and the plate material 6 is transported to the rolling mill stands $F_1$ to $F_n$ (S2). The front end of the plate material 6, immediately before being engaged between the work rolls 2 of the most upstream rolling mill stand $F_1$, is detected. In synchronism with this detection, the rolling mill stands $F_1$ to $F_n$ are adjusted and controlled to a set roll gap (S3).

Then, under monitoring by the tracking device 8, the rear end of the plate material 6, immediately before escaping from the most upstream rolling mill stand $F_1$, is detected. In synchronism with this detection, the roll gaps of the work rolls 2 in all the rolling mill stands $F_1$ to $F_n$ are controlled to "open" under the action of the hydraulic screw down control device 7. Also, the tensions between the respective adjacent two of the rolling mill stands $F_1$ to $F_n$ are simultaneously reduced to zero (S41). A rolling operation is repeated until a command for termination of operation is issued (S5).

According to the foregoing rolling method, immediately before release of the rear end of the plate material 6 from the most upstream rolling mill stand $F_1$, the roll gaps of the work rolls 2 in all the rolling mill stands $F_1$ to $F_n$ are simultaneously controlled to "open". Also, the tensions between the respective adjacent two of all rolling mill stands $F_1$ to $F_n$ are controlled to become zero. Thus, the difference in tension between the work side Ws and the drive side Ds can be made null between the adjacent rolling mill stands F's. Hence, simple control eliminates the risk for causing a zigzag motion to the rear end of the plate material 6, and prevents the occurrence of a pinch fold.

[Fifth Embodiment]

Figure 7:
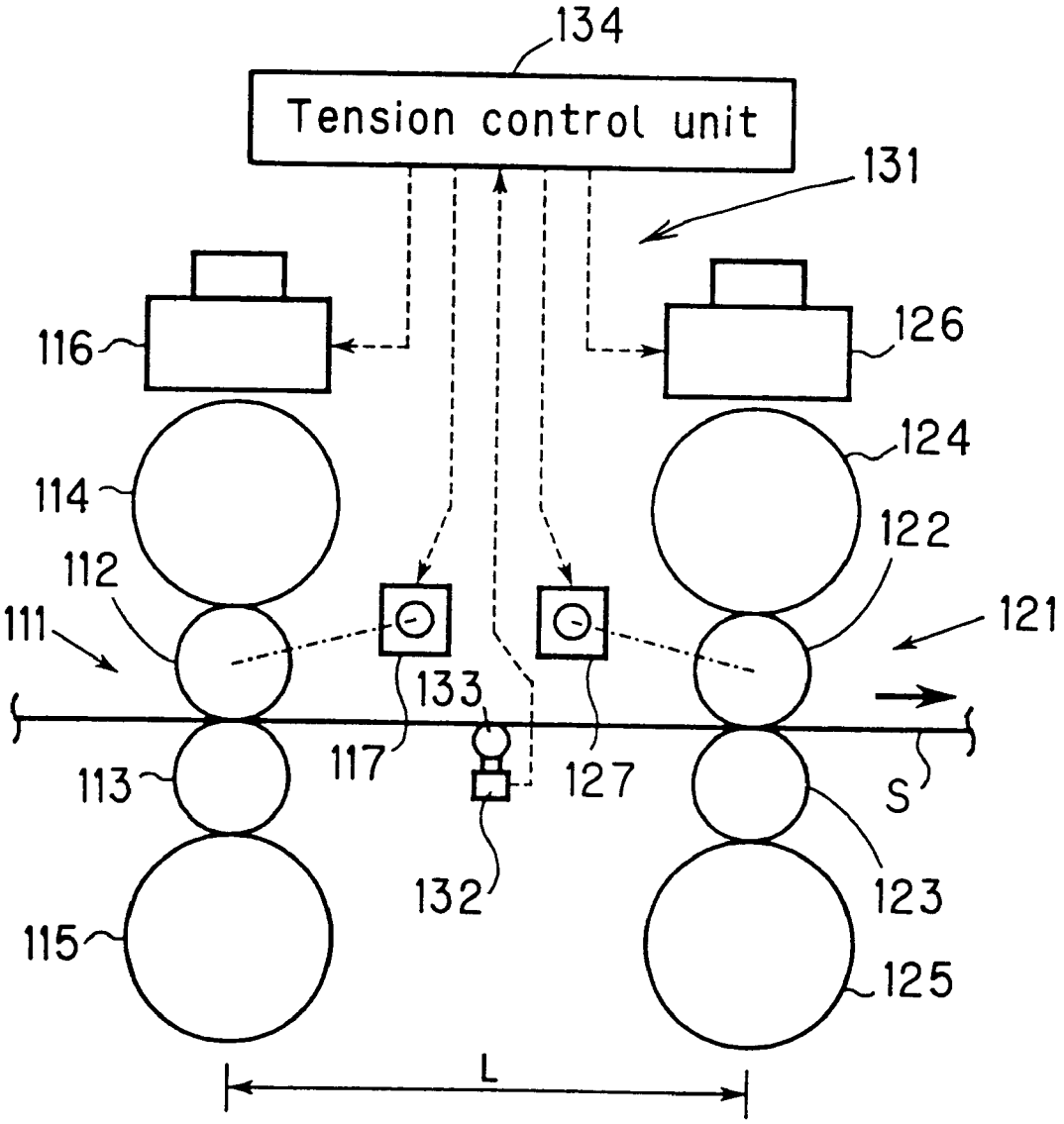
FIG. 7 is a schematic constitutional drawing of a rolling system showing a fifth embodiment of the present invention.
Figure 8:
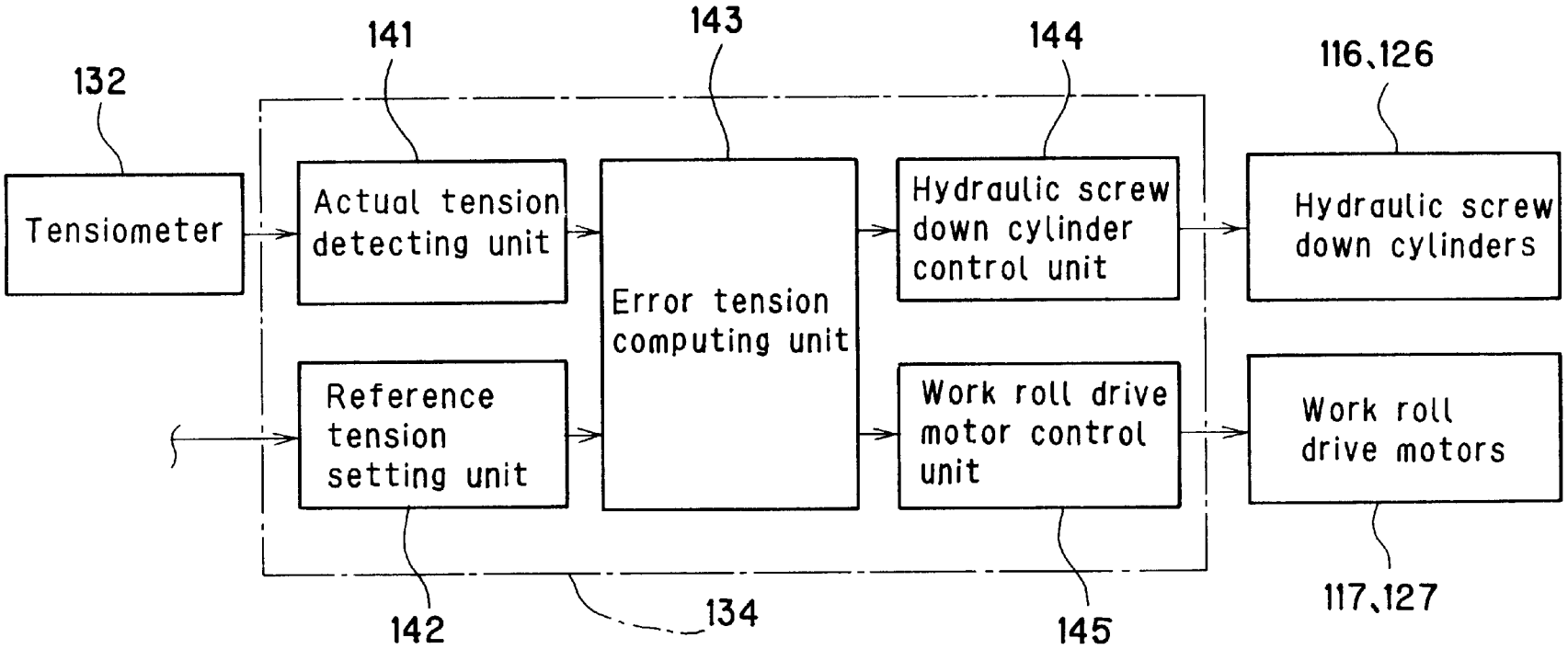
FIG. 8 is a control block diagram of a tension control unit in the fifth embodiment.

FIG. 7 is a schematic constitutional drawing of a rolling system showing a fifth embodiment of the present invention. FIG. 8 is a control block diagram of a tension control unit.

A rolling system for a strip (a material to be roiled) comprises a plurality of finishing mills (rolling mill stands) for finish rolling the strip, the finishing mills being arranged in a row in a direction of strip transport. The present embodiment describes a set of finishing mills, which are adjacent in a front-and-back direction among the plurality of finishing mills.

In the rolling system of this embodiment, as shown in FIG. 7, a set of (i.e., front and rear) finishing mills 111, 121 constituting the rolling system are installed with a predetermined spacing L. The finishing mill 111, located upstream in a direction of transport of a strip S, has a pair of (i.e., upper and lower) work rolls 112, 113 provided, opposite each other, in a stand (not shown). Above and below the work rolls 112, 113, backup rolls 114, 115 are provided, respectively, in contact with the work rolls 112, 113. Above the upper backup roll 114, a hydraulic screw down cylinder 116 is provided. To the upper and lower work rolls 112 and 113, a work roll drive motor 117 is connected.

The finishing mill 121, located downstream, has a pair of (i.e., upper and lower) work rolls 122, 123 provided, opposite each other, in a stand (not shown). Above and below the work rolls 122, 123, backup rolls 124, 125 are provided, respectively, in contact with them. Above the upper backup roll 124, a hydraulic screw down cylinder 126 is provided. To the upper and lower work rolls 122 and 123, a work roll drive motor 127 is connected.

Between the finishing mills 111 and 121, a tension control device 131 of the present embodiment is provided for adjusting the tension of the strip S that travels therebetween. That is, between the finishing mills 111 and 121, a plurality of tensiometers 132 are provided along a width direction of the traveling strip S, and a roller portion 133 contacts the underside of the strip S, whereby its tension can be detected.

To the tensiometer 132, a tension control unit 134 is connected. The tension control unit 134 is connected to the hydraulic screw down cylinder 116 of the finishing mill 111 and the drive motor 117, and also connected to the hydraulic screw down cylinder 126 of the finishing mill 121 and the drive motor 127.

When the tensiometer 132 detects the tension of the strip S traveling between the finishing mills 111 and 121, therefore, the result of detection is issued, as a tension signal, to the tension control unit 134. Based on an actual tension obtained from the entered tension signal, and a preset reference tension, the tension control unit 134 drivingly controls the hydraulic screw down cylinder 116 of the finishing mill 111 and the drive motor 117, and also drivingly controls the hydraulic screw down cylinder 126 of the finishing mill 121 and the drive motor 127. As a result, the actual tension can be adjusted and controlled to the reference value.

The tension control unit 134, as shown in FIG. 8, is composed of an actual tension detecting unit 141, a reference tension setting unit 142, an error tension computing unit 143, a hydraulic screw down cylinder control unit 144, and a work roll drive motor control unit 145. The actual tension detecting unit 141 computes a tension distribution in the width direction, and an actual tension averaged in the width direction, from a plurality of tension signals on the strip S which have been entered from the respective tensiometers 132. The reference tension setting unit 142 sets necessary tension for the strip S traveling between the finishing mills 111 and 121, as a reference tension on the basis of the rolling conditions such as the thickness and the travel speed of the strip S. The error tension computing unit 143 computes an error between the actual tension computed by the actual tension detecting unit 141 and the reference tension set by the reference tension setting unit 142, and computes the amount of adjustment for the tension of the strip S. The hydraulic screw down cylinder control unit 144 drivingly controls the hydraulic screw down cylinders 116, 126 of the finishing mills 111, 121 on the basis of the amount of tension adjustment for the strip S that has been computed by the error tension computing unit 143. The work roll drive motor control unit 145 drivingly controls the drive motors 117, 127 of the finishing mills 111, 121.

In finish rolling equipment with the so constituted tension control device 131, as shown in FIG. 7, the strip S is fed onto a transport roll table (not shown), and its front end is engaged sequentially between the work rolls 112, 113 and 122, 123 rotationally driven by the drive motors 117, 127 of the finishing mills 111, 121. On this occasion, when the work rolls 112, 113, 122, 123 are pressed by the hydraulic screw down cylinders 116, 117 via the backup rolls 114, 115, 124, 125, their roll gaps are adjusted to a certain level, so that the strip S is rolled to a predetermined thickness.

In a state in which the strip S is engaged between the work rolls 112 and 113, and 122 and 123 of the finishing mills 111, 121, tension occurs in the strip S. Simultaneously, the plurality of tensiometers 132 detect the tension of the strip S traveling between the finishing mills 111 and 121, and issues detection signals to the tension control unit 134. In the tension control unit 134, as shown in FIG. 8, the actual tension detecting unit 141 averages a plurality of tension signals on the strip S which have been entered from the tensiometers 132, to compute the actual tension. The error tension computing unit 143 computes the error between this actual tension and the reference tension set by the reference tension setting unit 142, to compute the amount of adjustment for the tension of the strip S.

The hydraulic screw down cylinder control unit 144 sets the amount of screw down on the basis of the amount of tension adjustment for the strip S, and drivingly controls the hydraulic screw down cylinders 116, 126 of the finishing mills 111, 121. The work roll drive motor control unit 145 sets a driving speed on the basis of the amount of tension adjustment for the strip S, and drivingly controls the drive motors 117, 127 of the finishing mills 111, 121. Thus, the strip S traveling between the finishing mills 111 and 121 is adjusted to a predetermined reference tension, so that appropriate finish rolling is performed.

The strip tension control device 131 of the present embodiment, as noted above, has the tensiometer 132 between the finishing mills 111 and 121 for detecting the tension of the strip S which travels therebetween. The tension control device 131 also has the tension control unit 134 for controlling the hydraulic screw down cylinders 116, 126 and the work roll drive motors 117, 127 on the basis of the actual tension detected by the tensiometer 132 and the preset reference tension, thereby adjusting and controlling the actual tension to the reference tension. Thus, when the strip S is engaged between the work rolls 112 and 113 and between the work rolls 122 and 123 of the finishing mills 111, 121 to generate tension, the plurality of tensiometers 132 simultaneously detect the tension of the strip S, and issue the tension signals to the tension control unit 134. Hence, responsiveness is dramatically improved, so that the tension of the strip S can be detected instantaneously and accurately. The tension control unit 134 instantaneously computes the amount of tension adjustment based on the actual tension and the reference tension, and drives the hydraulic screw down cylinders 116, 126 of the finishing mills 111, 121 and the drive motors 117, 127. Thus, a tension adjusting operation for the strip S can be performed in a very short time, so that fluctuations in the plate thickness can be decreased markedly, and the accuracy of the plate thickness can be increased.

As described above, the tension control device 131 for the strip S is composed of the tensiometer 132 and the tension control unit 134 disposed between the finishing mills 111 and 121, and a tension adjustment operation is performed by the hydraulic screw down cylinders 116, 126 and the drive motors 117, 127. Hence, it is not necessary to dispose conventional instruments, such as a revolving lever, a looper roll, and a looper drive motor, between the finishing mills 111 and 121, and the distance L therebetween can be shortened to about 2 to 3 m. Even if tension becomes zero in the end portion of the strip S that has left the work rolls 112 and 113 of the finishing mill 111, the length of the end portion decreases to less than a half of the conventional length. Consequently, a marked zigzag motion vanishes, and a pinch fold-associated accident can be inhibited.

According to the tension control device 131 for a strip in the foregoing embodiment, the tensiometer 132 is of a contact type in which the roller portion 133 contacts the underside of the strip S to detect tension. However, the tensiometer 132 may be of a non-contact type. The present embodiment gives a description in which the tension control device 131 is provided between a set of finishing mills 111 and 121 among a multiplicity of finishing mills constituting the rolling system. This tension control device 131, however, is also provided between other finishing mills (not shown)

[Sixth Embodiment]

Figure 9:
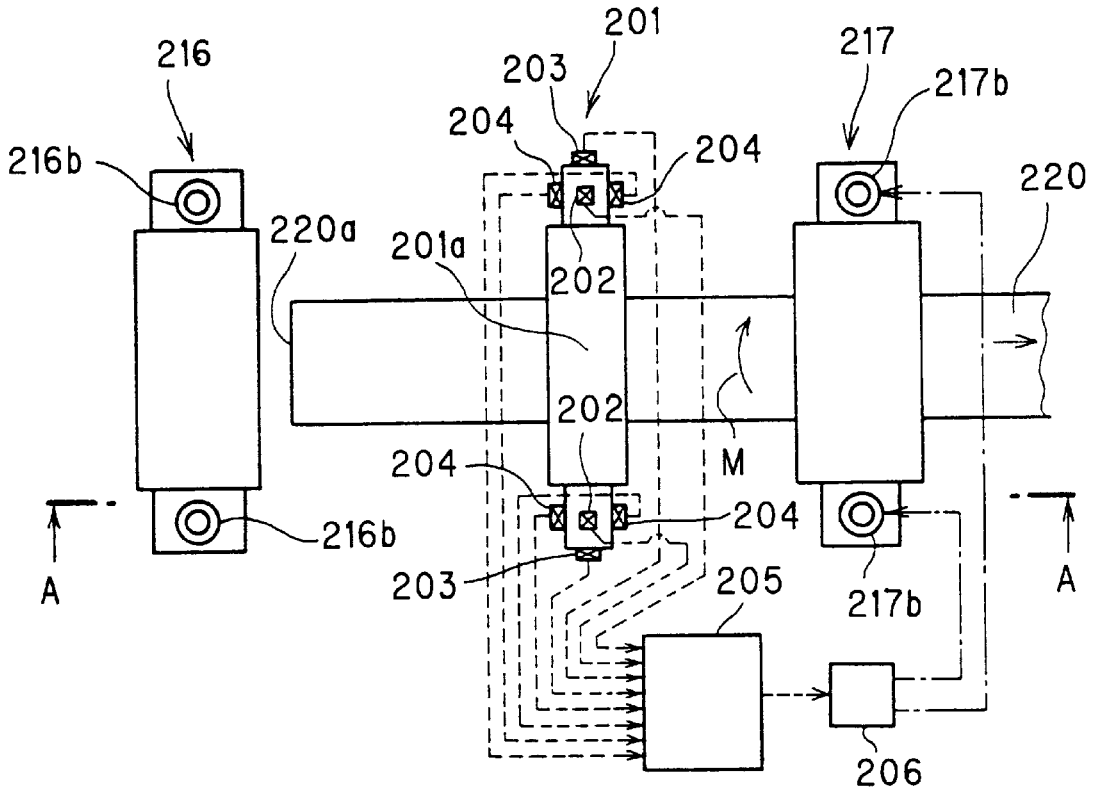
FIG. 9 is a plan view of a rolling system showing a sixth embodiment of the present invention.
Figure 10:
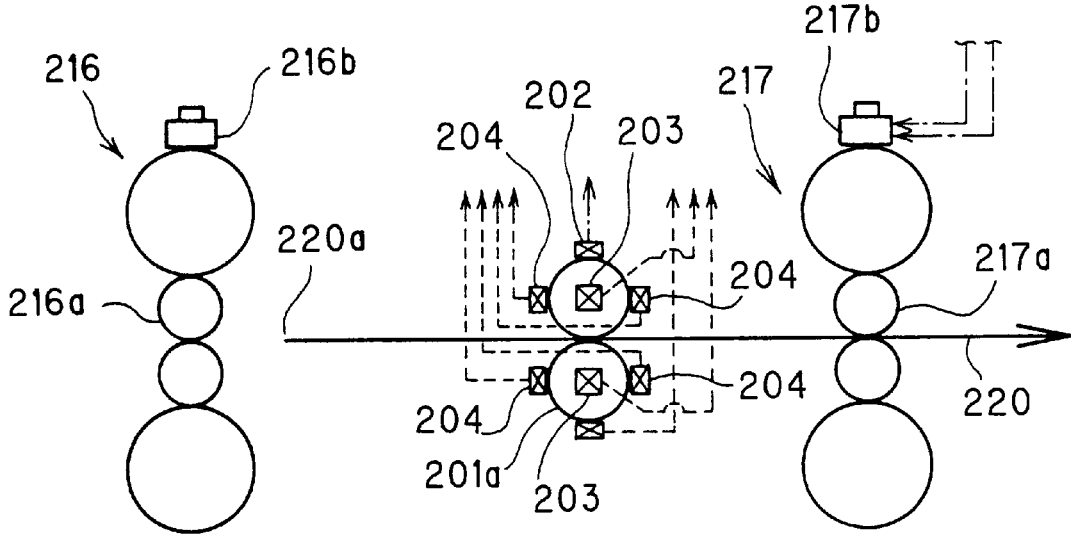
FIG. 10 is a view taken on line A—A of FIG. 9.
Figure 11:
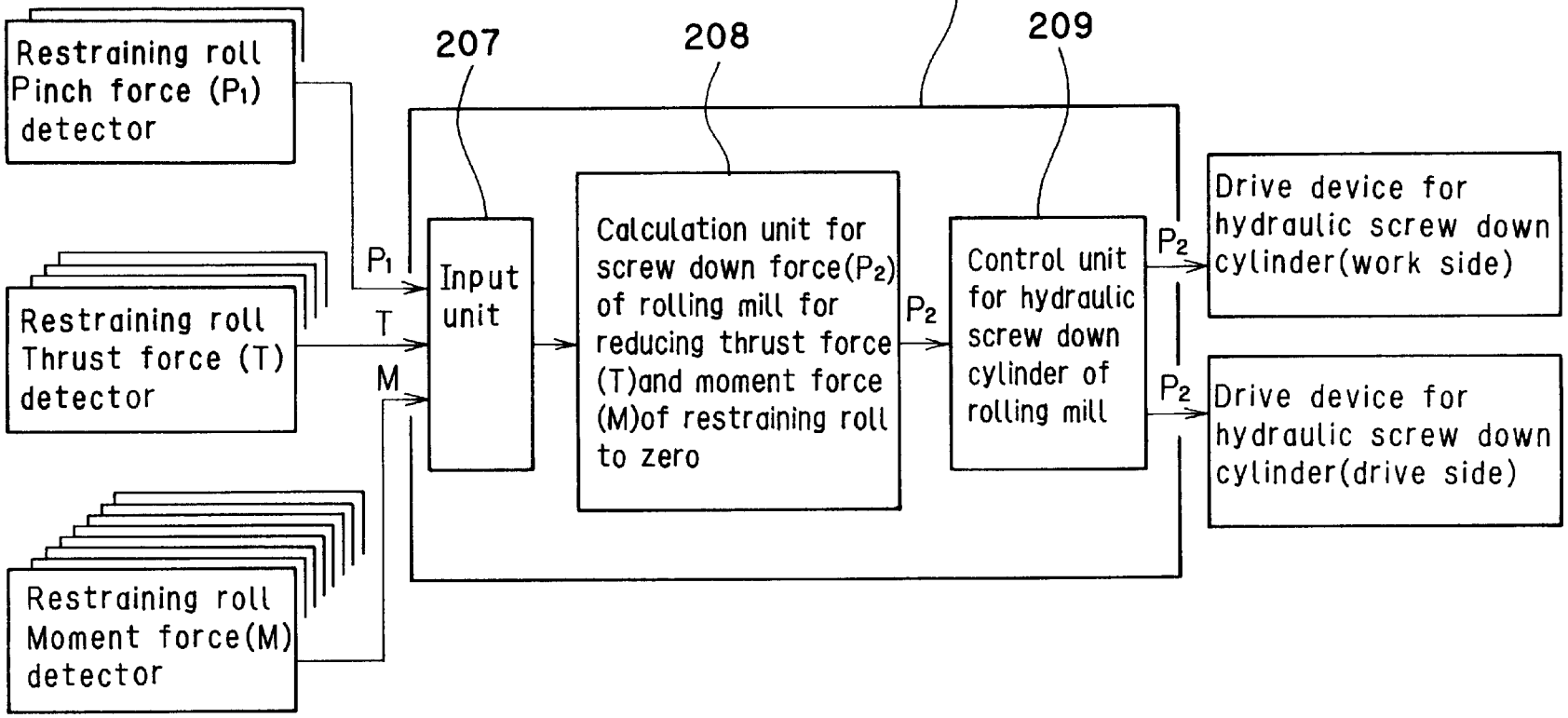
FIG. 11 is a block diagram of a control device in the sixth embodiment.

FIG. 9 is a plan view of a rolling system showing a sixth embodiment of the present invention. FIG. 10 is a view taken on line A—A of FIG. 9. FIG. 11 is a block diagram of a control device.

In FIGS. 9 and 10, the reference numerals 216 and 217 denote a No. 6 rolling mill and a No. 7 rolling mill, respectively, in a steel band hot finish rolling system comprising a No. 1 rolling mill (rolling mill stand) to a No. 7 rolling mill (rolling mill stand) arranged in tandem for finish rolling a steel band (a material to be rolled) 220. The numerals 216*a* and 217*a* denote work rolls of these rolling mills, while the numerals 216*b* and 217*b* denote hydraulic screw down cylinders thereof.

On an entry side of the No. 7 rolling mill 217, a restraining roll 201 comprising a pinch roll or a light pressure screw down rolling mill of a two-high roll 201*a* type is disposed. The restraining roll 201 may be provided on at least one of an entry side and a delivery side of an arbitrary rolling mill.

In the restraining roll 201, a pinch force ($P_1$) detector 202 is provided at a screw down portion of each roll 201*a*. A thrust force (T) detector 203 is provided near a shaft end of each roll 201*a*. A moment force (M) detector 204 is provided at each side portion of the shaft end of each roll 201*a*. Detection signals from these detectors are entered into a zigzag movement preventing control device 205.

The zigzag movement preventing control device 205 issues control signals to a screw down cylinder drive device 206 of the No. 7 rolling mill 217. The screw down cylinder drive device 206 drivingly controls the hydraulic screw down cylinder 217*b*.

The pinch force ($P_1$) detector 202, the thrust force (T) detector 203, the moment force (M) detector 204, and the zigzag movement preventing control device 205 are provided similarly on other restraining rolls 201*a* which are arranged similarly. The screw down cylinder drive device 206 is also provided similarly for each rolling mill.

The zigzag movement preventing control device 205, as shown in FIG. 11, is composed of an input unit 207 for receiving detection signals from the respective pinch force detectors 202, the thrust force detectors 203, and the moment force detectors 204; a calculation unit 208 for calculating the screw down force ($P_2$=hydraulic screw down force) of the adjacent rolling mill 217, for reducing to zero the thrust force (T) and moment force (M) of the restraining roll 201*a*, on the basis of the signals entered; and a control unit 209 for controlling the drive device 206 for work-side and drive-side hydraulic screw down cylinders 217*b*'s of the adjacent No. 7 rolling mill 217, on the basis of the screw down force ($P_2$) calculated by the calculation unit 208.

According to the present embodiment, the foregoing system is used to detect the pinch force ($P_1$) the thrust force (T), and the moment force (M) of the restraining roll 201, and to adjust and control work roll leveling of the rolling mill 217 adjacent to the restraining roll 201 on the basis of such information so that the thrust force (T) and the moment force (M) of the restraining roll 201 will be reduced to zero.

Because of the above-described constitution, when a rear end portion 220*a* of the steel band 220 is released from the work rolls 216*a* of the No. 6 rolling mill 216 in FIGS. 9 and 10, the rear end portion 220*a* side of the steel band 220 is pinched at two sites, i.e., the two-high rolls 201*a*'s of the restraining roll 201, and the work rolls 217*a*'s of the succeeding, adjacent No. 7 rolling mill 217.

Since the steel band 220 is pinched at the two sites, the rear end portion 220*a* side of the steel band is prevented from making a zigzag motion due to a difference in the amount of screw down between the right-hand part and left-hand part of the succeeding No. 7 rolling mill 217. Simultaneously, a bending moment force (M) occurs in the plane of the steel band 220. This moment force (M) is exerted on the restraining roll 201*a* as a thrust force (T) and a bending moment force (M).

The pinch force ($P_1$), thrust force (T) and moment force (M) imposed on the restraining roll 201*a* are detected, over time, by the pinch force ($P_1$) detector 202, thrust force (T) detector 203, and moment force (M) detector 204, taken in by the input unit 207 of the zigzag movement preventing control device 205, and conveyed to the calculation unit 208. In the calculation unit 208, screw down forces ($P_2$) on the drive side and the work side of the No. 7 rolling mill 217 are obtained which are necessary for reducing to zero the thrust force (T) and bending moment force (M) imposed on the restraining roll 201*a*. These screw down forces ($P_2$) are transmitted to the control unit 209 that controls the drive device 206 for the hydraulic screw down cylinder 217*b*.

Under control by the control unit 209, the drive-side and work-side screw down forces of the screw down cylinder drive device 206 are adjusted and controlled, whereby leveling of the work rolls 217*a* is adjusted. This action is repeated to decrease the bending moment force (M) that has occurred in the plane of the steel band 220. Thus, a rolling operation is performed, with the moment force (M) being kept zero.

Hence, a great wedge rate change minimally occurs in the restraining roll 201*a* and the adjacent No. 7 rolling mill 217, so that a great restraining moment (M) does not occur.

Figure 12A:
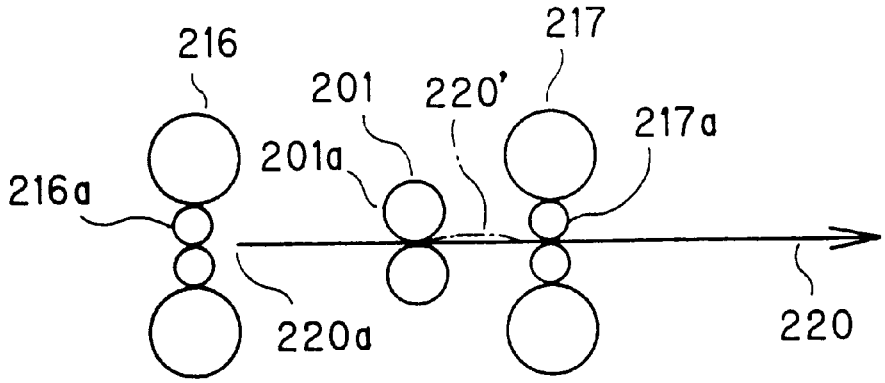
FIG. 12(*a*) and 12(*b*) are explanation drawings of an extra-plane deformation portion in the sixth embodiment, 12(*a*) being a side view of the rolling system, and 12(*b*) being a plan view of the rolling system.
Figure 12B:
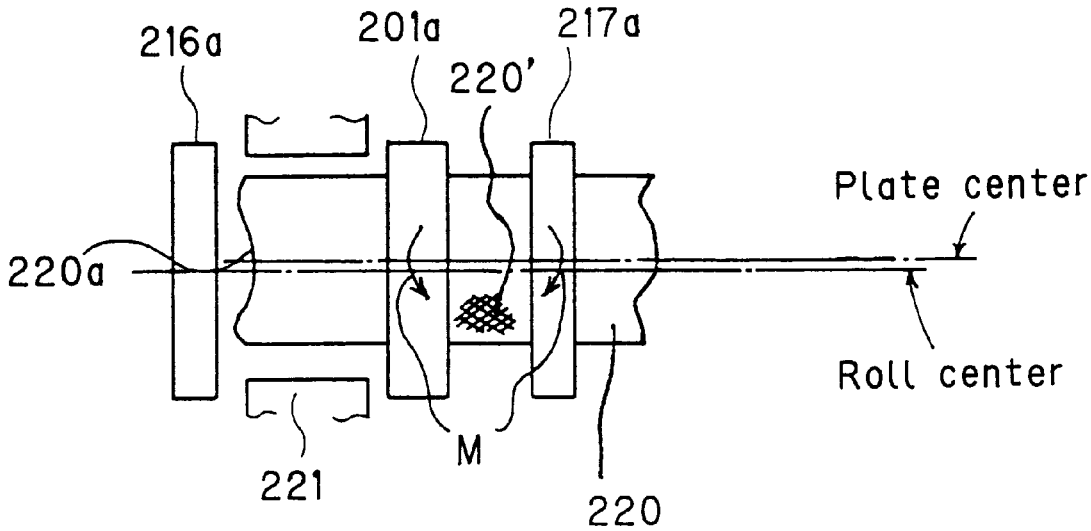

Thus, as shown in FIG. 12, an extra-plane deformation 220' associated with a great restraining moment (M) does not occur in a portion of the steel band 220 between the restraining roll 201*a* and the work rolls 217*a* of the adjacent No. 7 rolling mill 217. Consequently, a rapid fishtailing phenomenon associated with recovery from elastic deformation during release of the rear end of the steel band is avoided, so that zigzag movement of the rear end of the steel band can be prevented safely and reliably.

Needless to say, the present invention is not restricted to the above embodiments, and various changes and modifications may be made within a range not deviating the gist of the invention. This invention is also applicable to a reverse type finishing mill.

INDUSTRIAL APPLICABILITY

As described above, the rolling system and rolling method according to the present invention perform rolling while sequentially transporting a material to be rolled to a plurality of rolling mill stands, which involve detecting a travel situation of the material to be rolled; and rolling the material to be rolled, while driving work rolls of the rolling mill stand so as to rotate and so as to screw down, in accordance with the travel situation. Thus, zigzag movement of the rear end of the material to be rolled can be prevented by adjustment of the rolling speed, adjustment of the roll gap, and adjustment of work roll leveling, so that the occurrence of a pinch fold can be avoided. Hence, the rolling system and rolling method are preferred for use in hot finish rolling equipment.

What is claimed is:

1. A rolling system comprising:

a plurality of rolling mill stands including work rolls accommodating sequential transport of a material to be rolled therebetween, said work rolls being driveable to rotate and being driveable to screw down toward the material;

strip travel condition detecting means for detecting a rolling state of the material to be rolled including position detecting means for detecting a moving position of a rear end portion of the material and generating an end detection signal; and control means for controlling the work rolls based on the end detection signal from the position detecting means for reducing tension of the material being rolled to zero.

2. The rolling system of claim 1, wherein the control means is a control device for sequentially performing at least one of rotational speed adjustment of the work rolls by rotational speed adjusting means, and opening-direction adjustment of a roll gap of the work rolls by roll gap adjusting means when the rear end of the material to be rolled, immediately before being released from the rolling mill stand, is detected by the position detecting means.

3. The rolling system of claim 1, wherein the strip travel condition detecting means is a tensiometer for detecting the tension of the material to be rolled which travels between the plurality of rolling mill stands;and the control means is a tension control unit for controlling a screw down cylinder of the rolling mill stand and a work roll drive motor on the basis of an actual tension detected by the tensiometer and a preset reference tension, thereby adjusting and controlling the actual tension to a reference tension of zero.

4. The rolling system of claim 1, wherein the strip travel condition detecting means is a pinch force detector, a thrust force detector, and a moment force detector provided on a restraining roll disposed on at least one of an entry side and a delivery side of the rolling mill stand, said restraining roll comprising a light pressure screw down rolling mill; and the control means is a control device for adjusting work roll leveling of the adjacent rolling mill stand on the basis of information taken in from each of the detectors so that a thrust force and a moment force of the restraining roll will be reduced to zero.

5. A rolling method for performing rolling by sequentially transporting a material to be rolled to a plurality of rolling mill stands, comprising:

detecting a strip travel condition of the material to be rolled;

rolling the material to be rolled, while driving work rolls of the rolling mill stand so as to rotate and screw down, in accordance with the travel situation; and adjusting rotational speeds of the work rolls of the rolling mill stands when a rear end of the material to be rolled is detected to be immediately before being released from the rolling mill stand, so that the tension of the material to be rolled, located between the rolling mill stand immediately before release therefrom of the rear end of the material to be rolled and the rolling mill stand that follows it, will become zero.

6. The rolling method of claim 5, further comprising performing rolling while increasing the rotational speeds of the work rolls of the rolling mill stand immediately before release therefrom of the rear end so that the tension of the material to be rolled will become zero.

7. The rolling method of claim 5 for performing rolling by sequentially transporting the material to be rolled to the plurality of rolling mill stands, further comprising:

performing rolling while adjusting the rotational speeds of the work rolls when a rear end of the material to be rolled is detected to be immediately before being released from the most upstream rolling mill stand, so that the tension of the material to be rolled, located between all the rolling mill stands, will become zero.

8. The rolling method of claim 5 for performing rolling by sequentially transporting the material to be rolled to the plurality of rolling mill stands, further comprising:

performing rolling while sequentially adjusting a roll gap of the work rolls in an opening direction when a rear end of the material to be rolled is detected to be immediately before being released from the rolling mill stand, so that the tension of the material to be rolled, located between the rolling mill stand immediately before release therefrom of the rear end of the material to be rolled and the rolling mill stand that follows it, will become zero.

9. The rolling method of claim 5 for performing rolling by sequentially transporting the material to be rolled to the plurality of rolling mill stands, further comprising:

performing rolling while adjusting a roll gap of the work rolls in an opening direction when a rear end of the material to be rolled is detected to be immediately before being released from the rolling mill stand, so that the tension of the material to be rolled, located between all the rolling mill stands, will become zero.

10. The rolling method of claim 5 for performing rolling by sequentially transporting the material to be rolled to the plurality of rolling mill stands, further comprising:

detecting the tension of the material to be rolled which travels between the plurality of rolling mill stands; and controlling a screw down cylinder of the rolling mill stand and a work roll drive motor so as to eliminate an error between the detected tension and a preset reference tension.

11. The rolling method of claim 5 for performing rolling by sequentially transporting the material to be rolled to the plurality of rolling mill stands, further comprising:

detecting a pinch force, a thrust force, and a moment force of a restraining roll disposed on at least one of an entry side and a delivery side of the rolling mill stand, said restraining roll comprising a light pressure screw down rolling mill; and adjusting work roll leveling of the rolling mill stand adjacent to the restraining roll on the basis of information on the pinch force, thrust force and moment force detected, so that the detected thrust force and moment force will be reduced to zero.

* * * * *